US007112151B2

(12) United States Patent
Adams

(10) Patent No.: US 7,112,151 B2
(45) Date of Patent: Sep. 26, 2006

(54) GOLF CLUB ALIGNMENT APPARATUS

(76) Inventor: Steven L. Adams, 15801 Booth Cir., Leander, TX (US) 78641

( * ) Notice: Subject to any disclaimer, the term of this patent is extended or adjusted under 35 U.S.C. 154(b) by 0 days.

(21) Appl. No.: 10/850,188

(22) Filed: May 20, 2004

(65) Prior Publication Data

US 2005/0261072 A1 Nov. 24, 2005

(51) Int. Cl.
*A63B 69/36* (2006.01)
*A63B 37/00* (2006.01)
*A63B 43/06* (2006.01)

(52) U.S. Cl. ..... 473/409; 473/220

(58) Field of Classification Search ..... 473/219, 473/220, 223, 226, 409
See application file for complete search history.

(56) References Cited

U.S. PATENT DOCUMENTS 3,953,034 A 4/1976 Nelson
4,998,734 A * 3/1991 Meyer ..... 473/356
5,082,282 A 1/1992 Hernberg
5,169,150 A * 12/1992 Tindale ..... 473/220
5,193,812 A * 3/1993 Hendricksen ..... 473/220
5,207,429 A * 5/1993 Walmsley et al. ..... 473/220
5,482,283 A * 1/1996 Wall ..... 473/220
5,527,041 A * 6/1996 Terry et al. ..... 473/150
5,707,296 A * 1/1998 Hodgson et al. ..... 473/220
5,873,789 A 2/1999 Torriano
5,980,393 A 11/1999 Molinaroli et al.
6,482,099 B1 11/2002 Schaum
2003/0236136 A1* 12/2003 Dijkgraaf et al. ..... 473/351
2004/0092327 A1* 5/2004 Marnocha ..... 473/220

* cited by examiner

*Primary Examiner*—Raleigh W. Chiu

(57) ABSTRACT

A golf club alignment apparatus includes a golf club head portion which includes an optimal ball hitting portion also known as a "sweet spot". One or two laser units are connected to the golf club head portion, and the laser units project planar laser beams (e. g. fan beams), wherein portions of the planar laser beams impinge on the ground. The planar laser beams are oriented perpendicularly to a front face of the golf club head portion. The support platform projects outward from behind the golf club head portion. Each laser unit includes a laser beam generating portion for emitting a planar laser beam from the laser beam generating portion. Alignment of a target with a golf ball is aided by employing the planar laser beams.

2 Claims, 3 Drawing Sheets

FIG 1
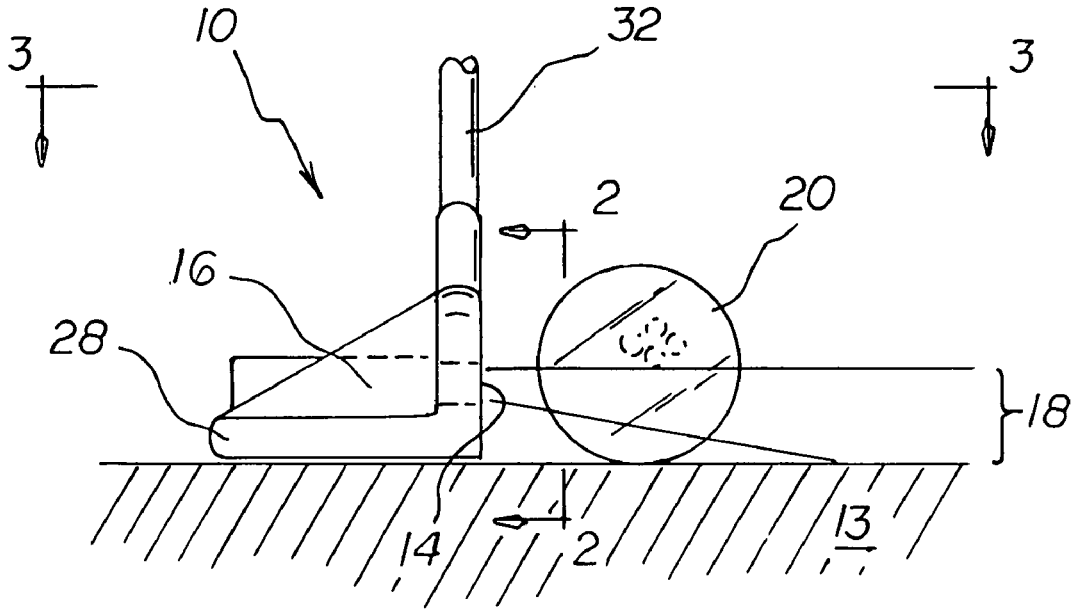
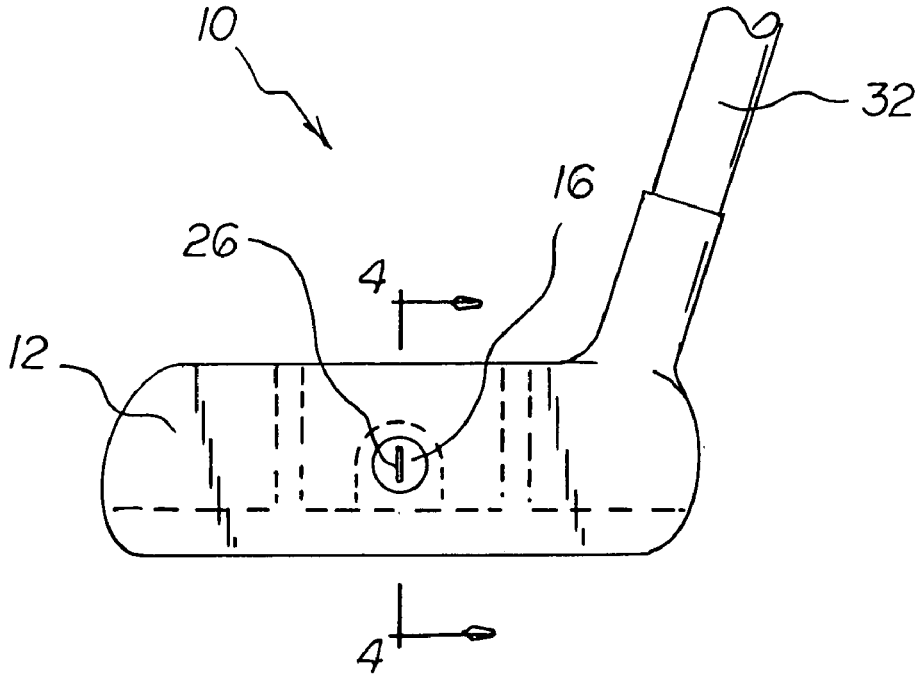
FIG 2

FIG 3
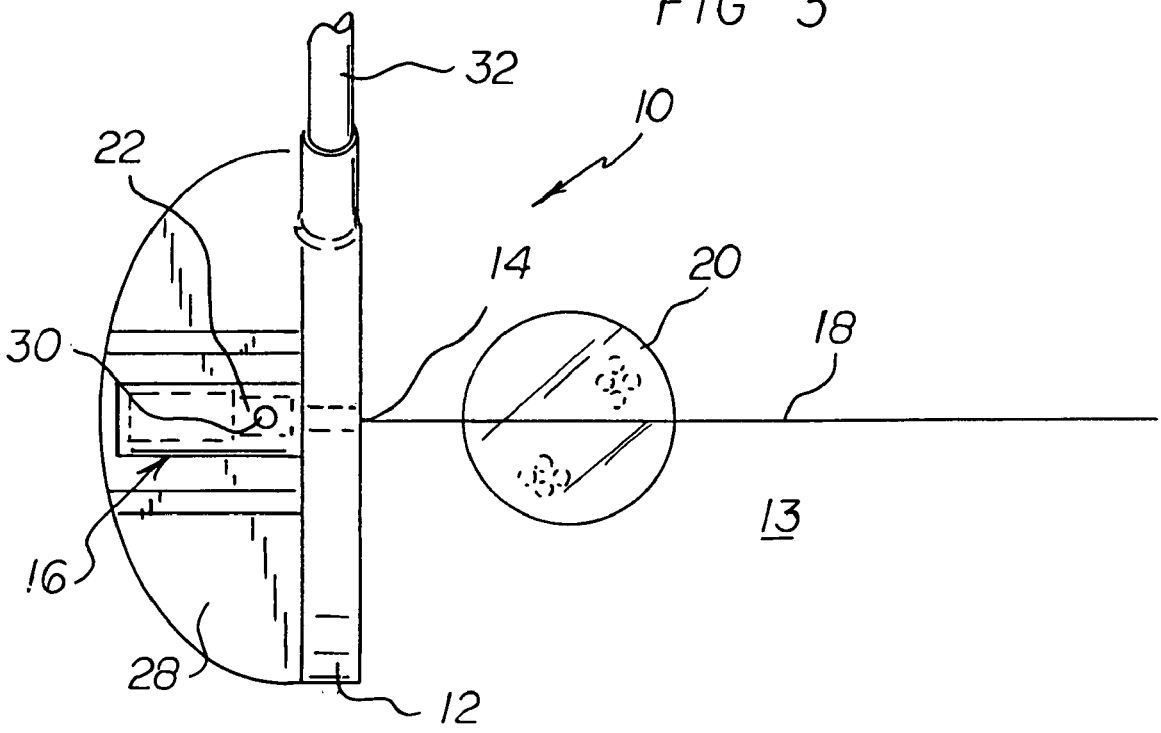
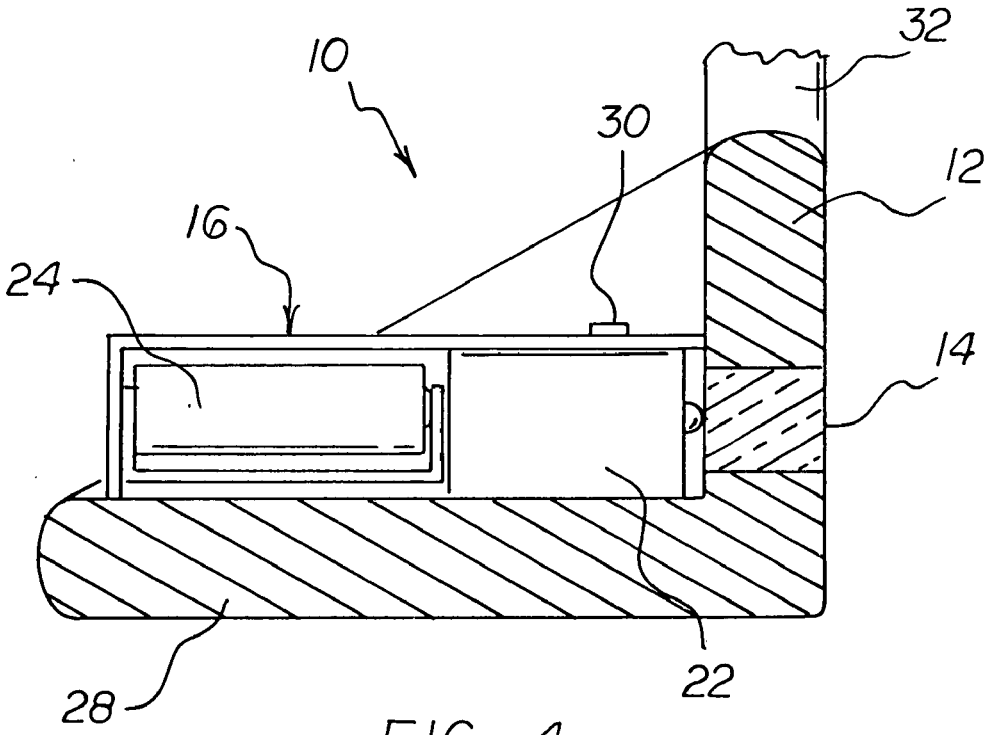
FIG 4

GOLF CLUB ALIGNMENT APPARATUS

BACKGROUND OF THE INVENTION

1. Field of the Invention

The present invention relates generally to devices for improving accuracy in hitting a golf ball with a golf club, and, more particularly, to an apparatus especially adapted for properly aligning the striking face of a golf club head with a golf ball.

2. Description of the Prior Art

Many devices are known in the prior art that are designed for a golfer to improve one's accuracy in hitting a golf ball along a straight line on the ground. Since it is well known that lasers emit straight-line beams of light, it has been suggested that lasers be employed in devices for improving the accuracy in hitting a golf ball.

Laser beams can be configured in a number of ways. For example, a laser beam can be emitted as a narrow pencil beam that impinges on a target as a spot beam. As another example, a laser beam can be emitted as a fan beam. A fan beam is a beam that is emitted as a beam that occupies a plane. Such a planar laser beam provides a two-dimensional plane within a three-dimensional space. In this respect, it would be desirable if a golf club alignment device were provided which emits a planar laser beam.

When a golf ball is to be hit, it rests on the ground. Also, to hit the golf ball, the head of a golf club is placed near the ground. In addition, the target towards which the golf ball is hit is also on the ground. In this respect, it would be desirable if a golf club alignment device were provided which employs a planar laser beam which aligns the golf club head with the target of the golf ball and which traverses the ground, thereby providing an illuminated ground path for the golf ball from the golf club head to the target.

Since a conventional golf ball is opaque, when a conventional golf ball is located along a straight planar laser beam between a golf club head and a target, the conventional golf ball will partially interrupt the ground-illuminating portion of the planar laser beam. To prevent this interruption of the ground-illuminating planar laser beam, a transparent golf ball could be provided.

Alternatively, to still employ a conventional golf ball with a planar laser beam, a pair of planar laser beams can be employed to bracket the conventional golf ball. In this respect, the pair of planar laser beams can provide a pair of uninterrupted illuminated tracks along the ground between which the conventional golf ball is to be hit to arrive at the target.

A wide variety of conventional golf club heads are currently in use. In this respect, it would be desirable if a retrofitting kit could be provided for converting a conventional golf club head into a golf club head that emits one or two ground-illuminating planar laser beams.

Thus, while the foregoing indicates it to be well known to use lasers for assisting in golfing accuracy, the prior art does not teach or suggest a golf club alignment apparatus which has the following combination of desirable features: (1) emits a planar laser beam; (2) employs a planar laser beam which aligns a golf club head with a target of the golf ball and which impinges on the ground, thereby providing an illuminated ground path for the golf ball from the golf club head to the target; (3) can employ a transparent golf ball; (4) can provide a pair of planar laser beams which provide a pair of uninterrupted illuminated tracks along the ground, between which a conventional golf ball is to be hit to arrive at the target; and (5) provides a retrofitting kit for converting a conventional golf club head into a golf club head that emits one or two ground-illuminating planar laser beams. The foregoing desired characteristics are provided by the unique golf club alignment apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a golf club alignment apparatus which includes a golf club head portion which includes an optimal ball hitting portion. A laser unit is connected to the golf club head portion, and the laser unit projects a planar laser beam, wherein a portion the planar laser beam impinges on the ground. The planar laser beam is oriented perpendicularly to a front face of the golf club head portion.

Preferably, a support platform is connected to the golf club head portion, and the support platform supports the laser unit. The support platform projects outward from behind the golf club head portion. The support platform is oriented perpendicularly with respect to the golf club head portion.

The laser unit includes a laser beam generating portion. A battery power source provides electric power to the laser beam generating portion, and a planar beam emitter is connected to the laser beam generating portion for emitting a planar laser beam from the laser beam generating portion.

With one embodiment of the invention, a single laser unit is installed on the golf club head portion so that the planar laser beam emanates from the optimal ball hitting portion. A transparent golf ball is provided which allows the planar laser beam to be transmitted through the transparent golf ball. The optimal ball hitting portion, a golf ball, and a target are aligned along the planar laser beam to facilitate hitting the target with the golf ball.

With another embodiment of the invention, a first laser unit provides a first planar laser beam, and a second laser unit provides a second planar laser beam. The first laser unit and the second laser unit are equidistant from the optimal ball hitting portion on opposite sides of the optimal ball hitting portion. The first laser unit produces a first planar laser beam, and the second laser unit produces a second planar laser beam. A straight illuminated corridor is provided on the ground between the first planar laser beam and the second planar laser beam. The optimal ball hitting portion of the golf club head portion, a golf ball, and a target are aligned in the straight corridor to facilitate hitting the target with the golf ball.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golf club alignment apparatus which has all of the advantages of the prior art and none of the disadvantages.

It is another object of the present invention to provide a new and improved golf club alignment apparatus which may be easily and efficiently manufactured and marketed.

It is a further object of the present invention to provide a new and improved golf club alignment apparatus which is of durable and reliable construction.

An even further object of the present invention is to provide a new and improved golf club alignment apparatus which is susceptible of a low cost of manufacture with regard to both materials and labor, and which accordingly is then susceptible of low prices of sale to the consuming public, thereby making such golf club alignment apparatus available to the buying public.

Still yet a further object of the present invention is to provide a new and improved golf club alignment apparatus which emits a planar laser beam.

Still another object of the present invention is to provide a new and improved golf club alignment apparatus that employs a planar laser beam which aligns a golf club head with a target of the golf ball and which impinges on the ground, thereby providing an illuminated ground path for the golf ball from the golf club head to the target.

Yet another object of the present invention is to provide a new and improved golf club alignment apparatus which can employ a transparent golf ball.

Even another object of the present invention is to provide a new and improved golf club alignment apparatus that can provide a pair of planar laser beams which provide a pair of uninterrupted illuminated tracks along the ground, between which a conventional golf ball is to be hit to arrive at the target.

Still a further object of the present invention is to provide a new and improved golf club alignment apparatus which provides a retrofitting kit for converting a conventional golf club head into a golf club head that emits one or two ground-illuminating planar laser beams.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a first embodiment of the golf club alignment apparatus of the invention which includes one laser emitting one planar laser beam and a transparent golf ball.

FIG. 2 is an enlarged partial front view of the embodiment of the golf club alignment apparatus shown in FIG. 1 taken along line 2—2 of FIG. 1.

FIG. 3 is a top view of the embodiment of the golf club alignment apparatus of FIG. 1 taken along line 3—3 thereof.

FIG. 4 is a cross-sectional view of the embodiment of the invention of FIG. 2, taken along line 4—4 thereof.

DESCRIPTION OF THE PREFERRED EMBODIMENT

Figure 5:
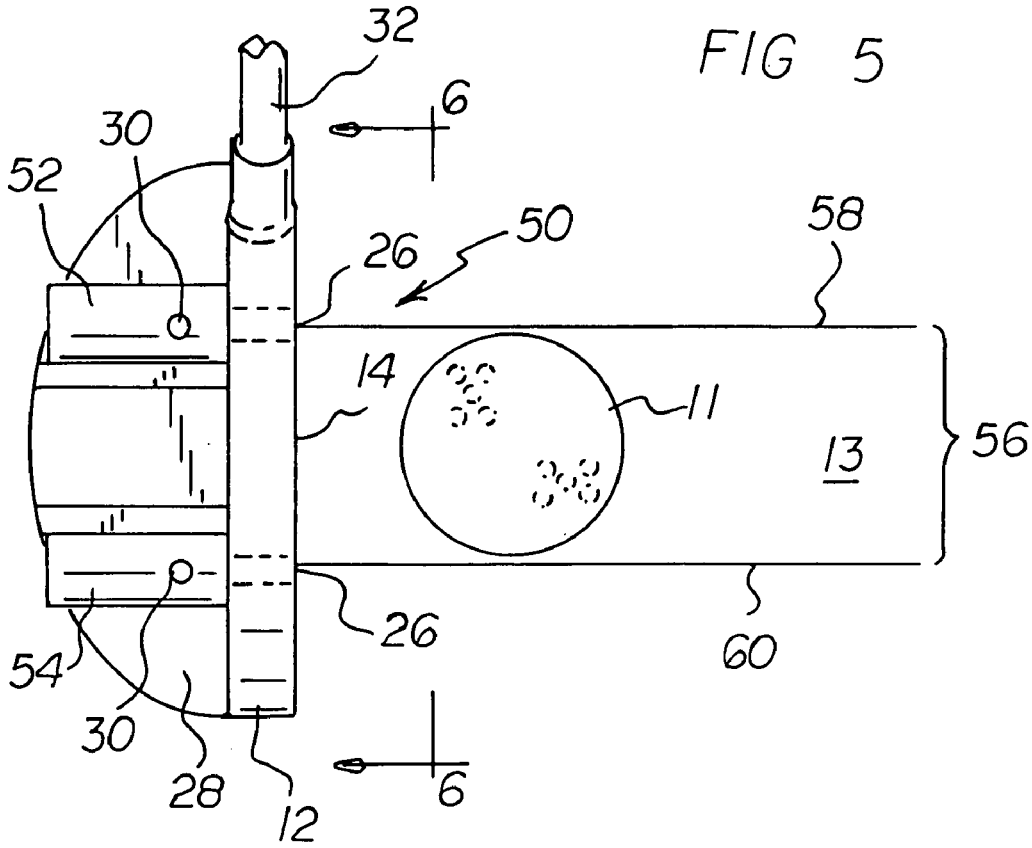
FIG. 5 is a top view of a second embodiment of the invention which includes two lasers emitting two planar laser beams providing an illuminated ground track for a conventional golf ball.

With reference to the drawings, a new and improved golf club alignment apparatus embodying the principles and concepts of the present invention will be described.

Turning to FIGS. 1–4, there is shown a first embodiment of the golf club alignment apparatus of the invention generally designated by reference numeral 10. In the first embodiment, golf club alignment apparatus 10 includes a golf club head portion 12 which includes an optimal ball hitting portion 14. A laser unit 16 is connected to the golf club head portion 12, and the laser unit 16 projects a planar laser beam 18, wherein a portion the planar laser beam 18 impinges on the ground 13. The planar laser beam 18 is oriented perpendicularly to a front face of the golf club head portion 12. The optimal ball hitting portion 14 is often referred to as the "sweet spot".

Preferably, a support platform 28 is connected to the golf club head portion 12, and the support platform 28 supports the laser unit 16. The support platform 28 projects outward from behind the golf club head portion 12. The support platform 28 is oriented perpendicularly with respect to the golf club head portion 12.

The laser unit 16 includes a laser beam generating portion 22. A battery power source 24 providing electric power to the laser beam generating portion 22, and a planar beam emitter 26 is connected to the laser beam generating portion 22 for emitting a planar laser beam 18 from the laser beam generating portion 22.

With the first embodiment of the invention 10, shown in FIGS. 1–4, wherein single laser unit 16 is installed on the golf club head portion 12 so that the planar laser beam 18 emanates from the optimal ball hitting portion 14 At the "sweet spot". A transparent golf ball 20 is provided which allows the planar laser beam 18 to be transmitted through the transparent golf ball 20.

To use the first embodiment of the invention 10. A user turns on the laser unit 16 by operating an on/off switch 30. Then, the user places either a conventional opaque golf ball 11 or a transparent golf ball 20 on the ground 13 at a distance from a target, such as a hole in a green. Then, the user places the front of the golf club head portion 12 near the respective golf ball. The user orients the golf club head portion 12 by lifting and rotating the golf club handle 32 as necessary to locate the central outside portion of the respective golf ball adjacent to the optimal ball hitting portion 14 or the "sweet spot" on the golf club head portion 12. The planar laser beam 18 emitted from the planar beam emitter 26 impinges on the central outside portion of the respective golf ball, on the ground 13, and on the target (not shown). When this is done, all of the planar laser beam 18, the central outside portion of the respective golf ball, the illuminated portion of the ground 13, and the target (not shown) are mutually aligned on the planar laser beam 18. This alignment facilitates accurate hitting of the respective golf ball to arrive at the target.

Figure 6:
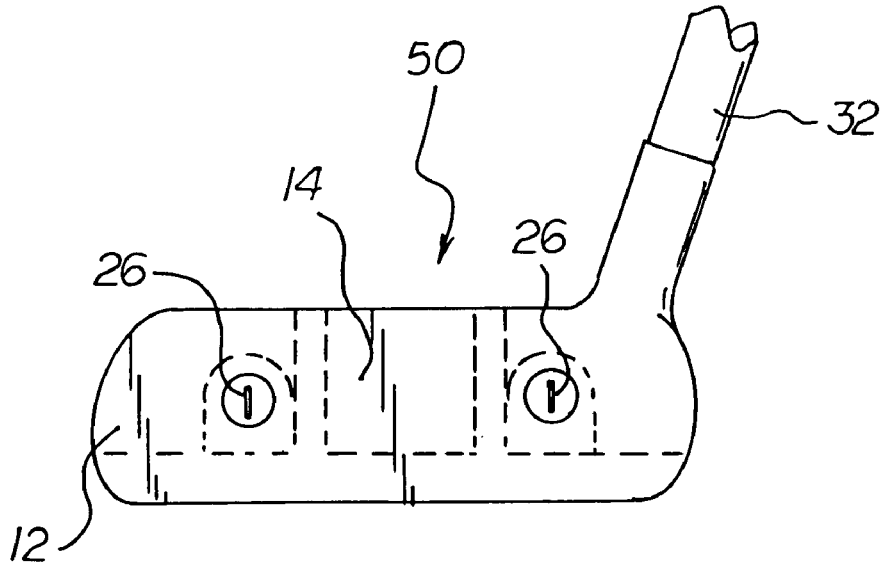
FIG. 6 is a front view of the embodiment of the invention shown in FIG. 5, taken along line 6—6 thereof.

With the second embodiment of the invention 50, shown in FIGS. 5 and 6, the laser unit is a first laser unit 52 which provides a first planar laser beam 58 a second laser unit 54 which provides a second planar laser beam 60. The first laser unit 52 and the second laser unit 54 are equidistant from the optimal ball hitting portion 14 on opposite sides of the optimal ball hitting portion 14.

To use the second embodiment of the invention 50, the first laser unit 52 and the second laser unit 54 are turned on so that the first planar laser beam 58 projects from the first laser unit 52, and the second planar laser beam 60 projects from the second laser unit 54. The first planar laser beam 58 provides a first illuminated straight line on the ground 13, and the second planar laser beam 60 provides a second illuminated straight line on the ground 13. In this respect, a pair of illuminated tracks are provided on the ground 13, and a straight corridor 56 on the ground 13 is defined between the pair of illuminated tracks.

Then, a conventional opaque golf ball 11 is placed on the ground 13 at a location away from the target (not shown), and the golf club handle 32 is lifted and turned adjacent to the central outside portion of the golf ball so that all of the optimal ball hitting portion 14 of the golf club head portion 12, the golf ball 11, and the target (not shown) are centrally located and aligned between the pair of illuminated tracks in the straight corridor 56. This alignment facilitates accurate hitting of the golf ball 11 to arrive at the target.

If desired, a retrofitting kit can be providing to convert a conventional golf club head into one of the invention. For a single laser kit, one hole is drilled in the conventional golf club head at the "sweet spot". Then, the single laser is installed on the golf club head portion 12.

For a dual laser retrofitting kit, two holes are drilled in the conventional golf club head at equidistant locations on opposites sides of the "sweet spot". Then, the two lasers are installed on the golf club head portion 12.

It is also contemplated that another embodiment of the invention could employ three laser units. One laser unit could be installed at the "sweet spot", and the other two laser units could be installed at equidistant locations on opposite sides of the "sweet spot". Then, a user would have the option of switching back and forth from a one laser unit (such as the first embodiment described above) to dual laser units (such as the second embodiment described above).

The laser unit 16, the first laser unit 52, and the second laser unit 54 can be a laser model called "Strait-Line" tool produced by American Tool Companies, Inc. of Wilmington, Ohio, U.S.A.

The components of the golf club alignment apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved golf club alignment apparatus that is low in cost, relatively simple in design and operation, and which may advantageously be used to emit a planar laser beam. With the invention, a golf club alignment apparatus is provided which employs a planar laser beam which aligns a golf club head with a target of the golf ball and which impinges on the ground, thereby providing an illuminated ground path for the golf ball from the golf club head to the target. With the invention, a golf club alignment apparatus is provided which can employ a transparent golf ball. With the invention, a golf club alignment apparatus is provided which can provide a pair of planar laser beams which provide a pair of uninterrupted illuminated tracks along the ground, between which a conventional golf ball is to be hit to arrive at the target. With the invention, a golf club alignment apparatus provides a retrofitting kit for converting a conventional golf club head into a golf club head that emits one or two ground-illuminating planar laser beams.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

The invention claimed is:

1. The method of aligning a golf club with a golf ball and a target on the ground, comprising the following steps:

(a) providing a transparent golf ball;

(b) providing a golf club with a ball hitting face and a laser beam generator mounted on said club wherein the laser beam from said laser generator extends substantially normal to said ball hitting face of said club;

(c) placing said transparent golf ball on the ground between said golf club and said target; and (d) placing said golf club in hitting position with respect to said transparent golf club on said ground such that said laser beam impinges on the central portion of said transparent golf club, said ground and said target whereby said laser beam, said central portion of said golf ball and said target are mutually aligned.

2. The method of claim 1 including the further step of:

(e) hitting said transparent golf ball with said golf club to cause said golf club to travel accurately along said aligned beam to said target.

* * * * *